United States Patent [19]

Nuttall, Jr. et al.

[11] 4,133,867

[45] Jan. 9, 1979

[54] COUNTER-CURRENT PROCESS WITH A HYDRODESULFURIZATION OF SOLID CARBONACEOUS MATERIALS

[75] Inventors: Herbert E. Nuttall, Jr., Albuquerque, N. Mex.; Allan S. Sass, Los Angeles, Calif.

[73] Assignee: Occidental Petroleum Corporation, Los Angeles, Calif.

[21] Appl. No.: 463,854

[22] Filed: Apr. 25, 1974

[51] Int. Cl.[2] ..... C01B 17/00; C10B 57/00

[52] U.S. Cl. ..... 423/244; 201/17; 423/659

[58] Field of Search ..... 423/242–244, 423/561 R, 659 F; 201/17

[56] References Cited

U.S. PATENT DOCUMENTS

| | | | |
|---|---|---|---|
| 2,037,790 | 4/1936 | Nuttall | 423/244 |
| 2,487,370 | 11/1949 | Putney | 423/659 F |
| 2,631,921 | 3/1953 | Odell | 423/659 F |
| 2,824,047 | 2/1958 | Gorin et al. | 201/17 |
| 3,640,016 | 2/1972 | Lee et al. | 201/17 X |
| 3,716,095 | 2/1973 | Ritzmann et al. | 423/659 F |
| 3,801,469 | 4/1974 | Essenhigh | 201/17 |

FOREIGN PATENT DOCUMENTS

| | | | |
|---|---|---|---|
| 1550440 | 11/1968 | France | 423/244 |

*Primary Examiner*—O. R. Vertiz
*Assistant Examiner*—Gregory A. Heller
*Attorney, Agent, or Firm*—John P. Grinnell; Forrest E. Logan

[57] ABSTRACT

Finely divided, sulfur bearing carbonaceous materials are carried by hydrogen in counter-current flow at elevated temperatures to the flow of relatively large, metal oxide, hydrogen sulfide accepting pellets. The sulfur contained in the carbonaceous material reacts with the carrier hydrogen to form hydrogen sulfide which, in turn, reacts with the metal oxide to form the corresponding metal sulfide and water. The water and unreacted carrier hydrogen are then separated from the desulfurized carbonaceous material and following separation of water from the residual hydrogen, the hydrogen is recycled with make up hydrogen at elevated pressures to the desulfurization zone. The formed metal sulfide pellets are removed from the base of the desulfurization zone and oxidized back to the oxide state for recycle back to the opposed end of the desulfurization zone.

21 Claims, 1 Drawing Figure

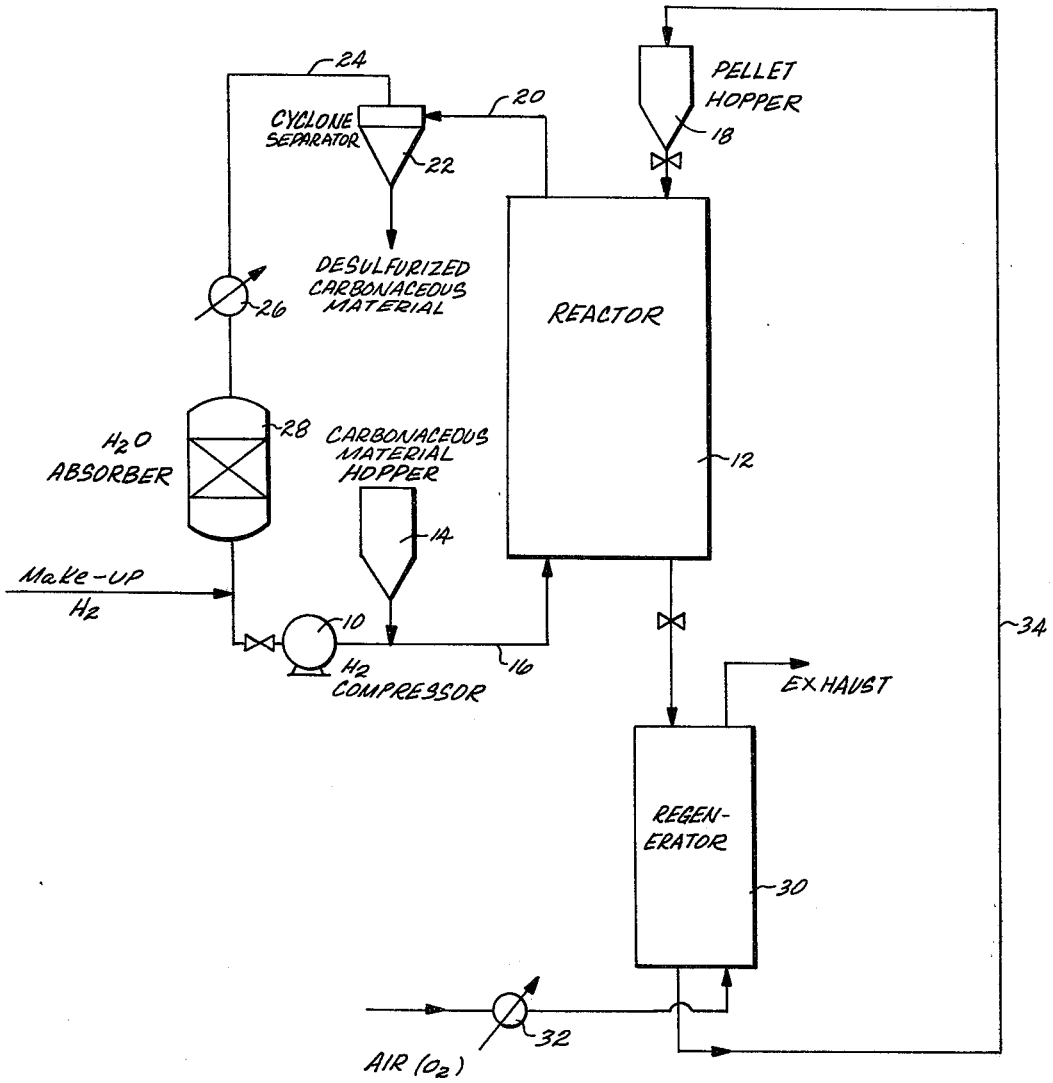
24
CYCLONE SEPARATOR
20
22
PELLET HOPPER
18
DESULFURIZED CARBONACEOUS MATERIAL
26
REACTOR
$H_2O$ ABSORBER
28
CARBONACEOUS MATERIAL HOPPER
12
14
Make-UP $H_2$
10
$H_2$ COMPRESSOR
16
34
EXHAUST
REGEN-ERATOR
30
32
AIR ($O_2$)

COUNTER-CURRENT PROCESS WITH A HYDROESULFURIZATION OF SOLID CARBONACEOUS MATERIALS

BACKGROUND OF THE INVENTION

Local and federal regulations regarding the emissions of sulfur dioxide to the atmosphere has stressed a need for using low sulfur fuels in various energy producing processes.

While there exists a supply of low sulfur solid and liquid carbonaceous fuels the supply is ever dwindling and efforts have been made to reduce the sulfur content of carbonaceous fuels whose sulfur content is presently too high for consumption in systems emitting flue gases to the atmosphere.

Many processes have been proposed for the desulfurization of solid carbonaceous fuels.

One such process is that described in U.S. Pat. No. 2,824,047 to Goren et al. The process consists of passing a non caking carbonaceous solid fuel containing sulfur, hydrogen, and a solid sulfur acceptor capable of reacting with or absorbing hydrogen sulfide concurrently through a zone at a temperature above about 1100° F whereby the hydrogen gas combines with the sulfur contained in the carbonaceous solid fuel to form hydrogen sulfide. The hydrogen sulfide which is formed reacts with the acceptor, typically a metal oxide, to form the corresponding sulfide of the metal. The effluent of the process is a mixture of the desulfurized carbonaceous solid fuel and the sulfided acceptor.

A major deficiency in the process proposed involves the separation of the desulfurized carbonaceous fuel from the solid sulfide acceptor in order to form a desulfurized carbonaceous solid fuel which is free of retained acceptor and an acceptor which is free of retained desulfurized carbonaceous fuel.

SUMMARY OF THE INVENTION

According to the present invention there is provided a process for the desulfurization of solid carbonaceous fuels which eliminates the major deficiencies which exist in prior art processes.

The process consists of passing a finely divided or particulate sulfur bearing solid carbonaceous fuel along with hydrogen as both a carrier-reactant for the sulfur contained in the carbonaceous fuel at an elevated pressure counter-currently to the gravitational flow of relatively large metal oxide hydrogen sulfide acceptor pellets in a desulfurization zone. The hydrogen carrier gas reacts with the sulfur contained in the carbonaceous fuel at a temperature of from about 1200° F to about 1800° F to form hydrogen sulfide which in turn reacts with the metal oxide in the pellets to form the corresponding sulfide with associated production of water vapor.

The stream exiting the upper portion of the desulfurization zone consists of a pellet free mixture of desulfurized carbonaceous material, water and any unreacted hydrogen. The desulfurized particulate carbonaceous material is then separated from the gas stream and following water removal, any residual hydrogen is combined with make-up hydrogen to serve as the carrier-reaction gas for a fresh charge of particulate carbonaceous solids to the desulfurization zone.

There is simultaneously withdrawn from the base of the desulfurization zone pellets of metal sulfide and any unreacted pellets of metal oxide which are passed to a regeneration zone where other techniques are possible. The pellets are regenerated to metal oxide pellets by conventional methods, for example, by reaction with air or oxygen at an elevated temperature to oxidize the metal sulfides to the oxide state. The metal sulfide can be recycled back to the upper portion of the desulfurization zone.

To achieve free passage of the finely divided carbonaceous material through the desulfurization zone in counter-current flow to the metal oxide acceptor pellets, the particle size of the carbonaceous material should be in the order of 200 mesh or less.

In addition, the size of the metal oxide hydrogen sulfide acceptor pellets should exceed the size of the particulate carbonaceous material by a ratio of about 50 to about 500 or more. For a carbonaceous material having a particle size of about 200 mesh, pellet size should range from about 0.2 to about 2 inch in diameter. The size and density of the pellets are selected to insure that the pellets will fall counter-current to the gaseous stream of carrier gas and char.

As hydrogen serves both as a carrier gas and the sulfur reactant, it should be supplied in an amount to react with the bound sulfur and at a pressure sufficient to provide a carrier gas to carry the particulate carbonaceous material through the desulfurization zone.

In general, depending upon the pressure drop through the desulfurization zone, the gas stream containing hydrogen or hydrogen and diluent is provided at a pressure ranging from about 15 to about 500 psia.

The heat required for the desulfurization reaction may be provided externally by preheating the pellets, the carbonaceous material, and/or the carrier gas.

The process of this invention has two important advantages. First of all, since the product carbonaceous material at the upper end or exit end of the desulfurization zone is brought in contact with a fresh feed of hydrogen sulfide acceptor pellets there exists a high potential for the pellets to react with trace amounts of hydrogen sulfide present at the exit end of the reactor, while at the inlet of the reactor where the concentration of hydrogen sulfide is substantially greater, there exists a great potential of the available hydrogen sulfide to react with available residual metal oxide in the hydrogen sulfide acceptor pellets.

In addition, the use of counter-current flow eliminates the need for separating the pellets from the desulfurized carbonaceous material following reaction in the desulfurization zone.

THE DRAWING

The attached drawing schematically illustrates a flow scheme for carrying out the process of this invention.

DESCRIPTION

According to the present invention there is provided a process for the desulfurization of particulate carbonaceous matter by the flow of a stream of particulate matter and carrier reactive hydrogen counter-currently with respect to the flow of relatively large pellets of a solid metal oxide.

According to the process the sulfur bound to the particulate carbonaceous material reacts with the carrier hydrogen at a temperature from about 1200° F to about 1800° F to form hydrogen sulfide by reactions such as:

$$RS + H_2 \rightarrow R + H_2S \quad (1)$$

wherein R is that portion of the carbonaceous particle bound to sulfur. The formed hydrogen sulfide interacts with the counter-current pellets by general reaction:

$$\text{Metal Oxide} + H_2S \rightarrow \text{Metal Sulfide} + H_2O \quad (2)$$

and in the particular instance where the hydrogen sulfide acceptor is iron oxide, the reaction is:

$$Fe_2O_3 + 2H_2S + H_2 \rightarrow 2FeS + 3\,H_2O \quad (3)$$

As used herein by the term "sulfur bearing carbonaceous material" there is meant a finely divided carbonaceous material preferably having a particle size of about 200 mesh or less and may be derived from any sulfur bearing carbonaceous material ranging from coals, chars, cokes and the like with char being defined as a carbonaceous material having undergone some thermal treatment to remove a part of the contained volatile matter. If the carbonaceous material is not available in the finely divided state as such, it may be rendered particulate in nature by known means of comminution.

By the term "metal oxide hydrogen sulfide acceptor pellets" there is meant a pelletized material having sufficient weight to pass in counter-current flow with an upward flow of the particulate carbonaceous material without entrapment and containing at least one metal oxide capable of reacting with hydrogen sulfide alone or with hydrogen sulfide and hydrogen to yield the corresponding metal sulfide and water as a by product. Illustrative but no wise limiting of the sulfur acceptors there may be mentioned pellets containing oxides of the metals such as calcium, iron, nickel, copper, zinc, cobalt, manganese, lead, mixtures thereof and the like. The pellets may be composed of the metal oxide(s) alone or metal oxide(s) deposited on a high temperature support such as silica or alumina. The pellets can be porous or non-porous. Preferably, the pellets are porous to enhance the effective surface area of the metal oxide of the pellet.

The hydrogen sulfide acceptor should be of a size sufficient to assure free gravitational flow of the pellets downward through an opposed upward flow of particulate carbonaceous material and its carrier-reactive gas to preclude entrainment of sulfur acceptor by the carrier gas.

In general the pelletized hydrogen sulfide acceptor should be of a size which is from about 50 to about 500 times the particle size of the particulate carbonaceous material undergoing desulfurization.

By the term "carrier gas" there is meant a stream of hydrogen alone, a stream comprising hydrogen, hydrogen sulfide and water as formed as a consequence of the desulfurization zone as well as hydrogen diluted with a low cost diluent carrier gas where the hydrogen requirements for the system are low due to the fact that the sulfur content of the carbonaceous material is already low to warrant the use of an inert gas, such as nitrogen or the like as part of the carrier gas.

With reference now to the drawings, the process of this invention while continuous in nature involves two separate and distinct loops. The first is for convenience termed the "carbonaceous feed loop", while the second is termed the "hydrogen sulfide acceptor feed loop".

The carbonaceous material feed loop begins with the compression of hydrogen alone or hydrogen with another inert carrier gas in compressor 10 where the hydrogen is compressed to the extent necessary in order to carry the particulate carbonaceous material through the reactor at a rate sufficient to achieve complete or substantially complete desulfurization of the particulate carbonaceous material to form hydrogen sulfide for reaction with the pelletized hydrogen sulfide acceptor. The carbonaceous material fed to the reactor 12 is normally contained in hopper 14. It may be fed at any temperature ranging from ambient to the temperature at which the desulfurization occurs.

Conveniently, the particulate carbonaceous material may undergo partial combustion to raise it to a temperature consonent with that employed during the desulfurization to maximize the rate of reaction between the bound sulfur and hydrogen and minimize residence time in reactor 12. Where the carbonaceous material is preheated, hopper 14 is normally insulated to retain the heat generated as consequence of partial combustion. Reactor 12 is a conventional solid pellet-gaseous reactor, such as a reduction reactor used for the reduction of iron ore pellets.

As the carbonaceous material and carrier gas are fed by line 16 to the base of reactor 12 there is simultaneously fed to the opposed or upper end of reactor 12 the pelletized hydrogen sulfide acceptor from hopper 18. Because the pelletized hydrogen sulfide acceptor is converted to its corresponding sulfide form and regenerated through oxidation at elevated temperatures to its oxide state, it will normally be fed to hopper 18 at a temperature consonant with that required for the desulfurization reaction in reactor 12 and may be the sole source of heat required for desulfurization.

In reactor 12 reactions (1) and (2) occur and there is withdrawn, with respect to the carbonaceous feed loop, an effluent through line 20 which consists of desulfurized particulate carbonaceous material, water vapor and any excess hydrogen and/or inert carrier gas fed to reactor 12. This is in turn passed to a separation zone 22 which may typically be a cyclone separator where the hot particulate carbonaceous product is settled out and the gas stream consisting of water vapor, excess hydrogen and/or inert gas is withdrawn overhead. This gas stream is passed by line 24 through cooler 26 then to water absorber 28 containing any conventional desiccant for removal of water from the gas stream. A typical desiccant which may be employed are the glycols. The resultant stream exiting at absorber 28 is combined with make-up hydrogen which accounts, in substance, for the amount of water formed in desulfurization reactor 12 and fed to compressor 10 to resume the carbonaceous feed loop.

In the preferred operation, hydrogen alone is used as the carrier reactor gas and is preferably present in excess of that required for reaction with bound sulfur to form hydrogen sulfide. For most carbonaceous materials and depending upon the sulfur content of the gas stream, normally the amount of hydrogen alone or hydrogen plus inert gas fed to reactor 12 will range from about 0.005 to about 0.5 pounds per pound of particulate carbonaceous material depending, as indicated on the amount of sulfur to be removed and the amount of lift required to carry the particulate carbonaceous material through reactor 12. This will depend on part, too, on the resistance to flow and generally feed pressures of from about 15 to about 500 psia are required to carry all of the carbonaceous material through reactor 14 without their being entrained by the pelletized hydrogen sulfide acceptor.

As indicated, net desulfurization occurs as a consequence of counter-current flow of a pelletized hydrogen sulfide acceptor, such as iron oxide, from hopper 18 through reactor 12. The pellets flow to reactor 12 by gravity and are fed at a rate which is a function of the sulfur content and the rate of the feed of particulate carbonaceous material to reactor 12, hydrogen sulfide acceptability of the pelletized hydrogen sulfide acceptor and the amount of sulfur to be removed from the carbonaceous material.

The rate of flow may therefore be adjusted widely to meet a variety of conditions. In general, however, to assure a high degree of desulfurization, the amount of pellets fed from hopper 18 to reactor 12 is generally in excess of that required to react with all of the sulfur freed from the particulate carbonaceous material as a consequence of its reaction with hydrogen to form hydrogen sulfide.

There is withdrawn, therefore, at the base of reactor 12 an effluent consisting of sulfided pellets which are then fed to regenerator 30, typically a rotary kiln. There, there is fed oxygen or air, normally preheated in preheater 32, to regenerator 30 where the pellets are heated to a temperature at which the sulfides present will be oxidized to sulfur dioxide and the hydrogen sulfide acceptor returned to its oxide state.

In the instance of the use of iron oxide as the pelletized acceptor, this will require heating to a temperature of from about 1500° to about 1600° F. The oxidized or regenerated sulfur acceptor is then withdrawn from the regenerator 30, passed by line 34 to insulated hopper 18 for feed to reactor 12.

The sulfur dioxide which leaves the generator 30 may be passed to any convenient system for the production of sulfur or sulfuric acid to avoid its passage to atmosphere as a pollutant. Alternatively, the sulfur dioxide may be converted to a sulfate by treatment with molten carbonate.

A production advantage of the invention is that ability to use acceptor pellets composed of materials which display low efficiency with respect to hydrogen sulfide acceptance. Iron oxide, for instance, is a preferred acceptor in the process of this invention because of low cost, strength, resistance to deterioration and ease of regeneration. In other systems used for desulfurization of carbonaceous materials such as char, iron oxide would not be used. Fixed-bed, fluidized-bed and similar operations could not be readily adapted to the use of iron oxide because of its known low efficiency as an acceptor.

EXAMPLE

Char containing 2 percent by weight bound sulfur and ground to a particle size of less than 200 mesh is partially combusted to raise its temperature to 1650° F and stored in an insulated feed hopper. The heated char is combined at the rate of 100 parts by weight per hour with 1.66 parts by weight per hour of compressed hydrogen for feed to the base of a vertically disposed desulfurization reactor. Simultaneously there is fed to the opposed end of the reactor iron oxide pellets ranging in size from 0.5 to 1 inch in diameter at the rate 6.17 parts by weight per hour. The iron oxide pellets have a temperature between 1500° and 1600° F.

The hydrogen which carries the ground char through the reactor also reacts with the bound sulfur to form hydrogen sulfide. Hydrogen sulfide and excess hydrogen react with the iron oxide to form iron sulfide and vaporized water.

The desulfurized char leaves the reactor at the rate of 98 parts by weight per hour along with 1.47 parts by weight per hour hydrogen and 1.68 parts by weight per hour water and is passed to a cyclone separator where the char product is separated from a vapor stream of hydrogen and water. The vapor stream is passed to a water absorber and the hydrogen along with 0.19 parts by weight per hour make up hydrogen are compressed for recycle with hot char to the desulfurization reactor.

There is withdrawn from the base of the reactor 5.48 parts by weight iron sulfide and 1.19 parts by weight unconverted iron oxide per hour in pellet form. The pellets are passed to a rotary kiln to which there is fed preheated air at the rate of 16.67 parts by weight per hour to oxide the iron sulfide to iron oxide at a temperature between 1500° and 1600° F. There is withdrawn from the kiln an exhaust which consists of 3.95 parts by weight per hour sulfur dioxide and 13.14 parts by weight per hour nitrogen and well as 6.17 parts by weight per hour iron oxide pellets for recycle to the desulfurization reactor.

What is claimed is:

1. A process for the desulfurization of solid particulate sulfur bearing carbonaceous materials which comprises:

(a) passing the solid particulate sulfur bearing carbonaceous material in admixture with a carrier gas stream comprising hydrogen at an elevated pressure through a desulfurization zone counter-current to the flow of metal oxide hydrogen sulfide acceptor pellets having a particle size from about 50 to about 500 times greater than the particle size of the solid particulate carbonaceous material, said desulfurization zone being maintained at a temperature from about 1200° to about 1800° F wherein the sulfur contained in the solid particulate carbonaceous material reacts with hydrogen to form hydrogen sulfide which reacts with the metal oxide to form the corresponding metal sulfide and water;

(b) removing a stream comprising desulfurized carbonaceous material, water and carrier gas from one end of the desulfurization zone while removing pellets containing metal in the sulfide state from the opposed end of the desulfurization zone.

2. A process as claimed in claim 1 in which the desulfurized carbonaceous material and water are separated from the carrier gas to form a residual carrier gas and hydrogen is added to the residual carrier gas to reconstitute the carrier gas stream for recycle with sulfur bearing carbonaceous material to the desulfurization zone.

3. A process as claimed in claim 1 in which the pellets containing metal in the sulfide state are oxidized to the metal oxide state and returned to the desulfurization zone for counter-current flow to the flow of said sulfur bearing carbonaceous material and carrier gas in said desulfurization zone.

4. A process as claimed in claim 1 in which the carrier gas stream containing sulfur bearing carbonaceous material is fed to the desulfurization zone at a pressure from about 15 to about 500 psia.

5. A process as claimed in claim 2 in which the carrier gas stream containing sulfur bearing carbonaceous material is fed to the desulfurization zone at a pressure from about 15 to about 500 psia.

6. A process as claimed in claim 1 in which the sulfur bearing carbonaceous material has an average particle size about 200 mesh or less and the metal oxide hydrogen sulfide acceptor pellets have an average particle size of from about 0.2 to about 2.0 inches.

7. A process as claimed in claim 4 in which the sulfur bearing carbonaceous material has a particle size of about 200 mesh or less, and the metal oxide hydrogen sulfide acceptor pellets have an average particle size of from about 0.2 to about 2.0 inches.

8. A process as claimed in claim 1 in which the carrier gas is hydrogen.

9. A process as claimed in claim 4 in which the carrier gas is hydrogen.

10. A process as claimed in claim 8 in which the sulfur bearing carbonaceous material has a particle size of about 200 mesh or less and in which the metal oxide hydrogen sulfide acceptor pellets have a particle size of from about 0.2 to about 2.0 inches.

11. A process as claimed in claim 1 in which the weight ratio of carrier gas to particulate sulfur bearing carbonaceous material is from about 0.005 to about 0.5.

12. A process as claimed in claim 4 in which the weight ratio of carrier gas to particulate sulfur bearing carbonaceous material is from about 0.005 to about 0.5.

13. A process is claimed in claim 8 in which the weight ratio of hydrogen to particulate sulfur bearing carbonaceous material is from about 0.0005 to about 0.5.

14. A process as claimed in claim 9 in which the weight ratio of hydrogen to particulate sulfur bearing carbonaceous material is from about 0.005 to about 0.5.

15. A process as claimed in claim 1 in which the metal oxide hydrogen sulfide acceptor pellets contain at least one oxide of a metal selected from the group consisting of calcium, iron, nickel, copper, zinc, cobalt, manganese, lead, and mixtures thereof.

16. A process as claimed in claim 1 in which the metal oxide hydrogen sulfide acceptor pellets are supplied to the desulfurization zone at a temperature sufficient to maintain the desulfurization zone at the temperature required for desulfurization.

17. A process as claimed in claim 16 in which the particulate sulfur bearing carbonaceous material is partially oxidized to heat said sulfur bearing carbonaceous material to a temperature required for desulfurization prior to introduction to the desulfurization zone.

18. A process as claimed in claim 4 in which the metal oxide hydrogen sulfide acceptor pellets are supplied to the desulfurization zone at a temperature sufficient to maintain the desulfurization zone at the temperature required for desulfurization.

19. A process as claimed in claim 18 in which the particulate sulfur bearing carbonaceous material is partially oxidized to heat said sulfur bearing carbonaceous material to a temperature required for desulfurization prior to introduction to the desulfurization zone.

20. A process as claimed in claim 8 in which the metal oxide hydrogen sulfide acceptor pellets are supplied to the desulfurization zone at a temperature sufficient to maintain the desulfurization zone at the temperature required for desulfurization.

21. A process as claimed in claim 20 in which the particulate sulfur bearing carbonaceous material is partially oxidized to heat said sulfur bearing carbonaceous material to a temperature required for desulfurization prior to introduction to the desulfurization zone.

* * * * *